US006805029B1

(12) United States Patent
Foster et al.

(10) Patent No.: US 6,805,029 B1
(45) Date of Patent: Oct. 19, 2004

(54) EXTENSIBLE SPEED WRENCH CROWFOOT WRENCH HEAD

(75) Inventors: Michael L. Foster, Kenosha, WI (US); Michael T. DeKeuster, Racine, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 0 days.

(21) Appl. No.: 10/346,687

(22) Filed: Jan. 17, 2003

(51) Int. Cl.[7] ..... B25B 13/00
(52) U.S. Cl. ..... 81/186; 81/119; 81/177.2
(58) Field of Search ..... 81/186, 121.1, 81/177.2, 177.85, 119, 176.1

(56) References Cited

U.S. PATENT DOCUMENTS 1,498,712 A * 6/1924 York ..... 81/177.75
2,005,202 A * 6/1935 Pilger ..... 464/119
2,304,766 A * 12/1942 Pratt ..... 464/119
3,875,828 A 4/1975 Evans
3,905,255 A 9/1975 Evans
4,774,862 A * 10/1988 Scull ..... 81/119
5,551,322 A * 9/1996 Mikic et al. ..... 81/186
5,582,083 A * 12/1996 Baker ..... 81/119
5,671,644 A * 9/1997 Anderson ..... 81/119
5,931,063 A * 8/1999 Kuo ..... 81/119
5,996,445 A 12/1999 Wiens et al.
6,276,240 B1 8/2001 Blacklock
6,334,375 B1 * 1/2002 Belcher ..... 81/176.1

* cited by examiner

*Primary Examiner*—Lee D. Wilson
(74) *Attorney, Agent, or Firm*—Seyfarth Shaw LLP

(57) ABSTRACT

An extensible ratcheting-type wrench head for imparting torque to a fastener having a plurality of sides. The wrench head comprises a lug aperture for mateably receiving a drive lug disposed on an extension handle.

14 Claims, 2 Drawing Sheets

EXTENSIBLE SPEED WRENCH CROWFOOT WRENCH HEAD

BACKGROUND

This application is related to and commonly assigned with U.S. Pat. No. 5,551,322, issued to Mikic et al. on Sep. 3, 1996, the disclosure of which is incorporated herein by reference.

The present application relates generally to tools for turning threaded fasteners, such as bolts, nuts and the like, and more particularly to ratcheting open-end wrench heads, commonly known as speed wrenches.

Hexagonal fasteners, such as common bolt heads or nuts, may be located in areas with very limited accessibility, which impedes a conventional open-end wrench's rotational movement. With a conventional open-end wrench, a minimum 60 degree rotational path is required in order to rotate the fastener enough for disengagement and subsequent re-engagement. A common practice in the art to somewhat extend an open ended wrench's rotational movement is to offset the wrench head at a fixed angle relative to the wrench handle. Typically, this angle ranges from 15 to 60 degrees. However, this practice still does not solve the obstacle problem, but rather allows the user to engage the fastener head at a different approach angle with the hope of extending its rotational movement by avoiding obstacles.

Alternately, a user may employ a ratchet and socket assembly which allows the socket to maintain constant contact with the fastener head while enabling the ratchet body to return to the starting point. However, this assembly's use is still extremely limited because it is generally cumbersome and large, due to the internal mechanical components of the ratcheting mechanism. As such, the assembly often cannot be used because it is too large to fit over a fastener's head due to the limited clearance relative to an obstacle.

To combat this problem, the prior art includes ratcheting open-end wrench heads which provide a ratcheting-type action without the use of complex and sizable ratchet wheels or other moving parts. The ratcheting action is generally accomplished by providing respective long and short driving surfaces in the wrench head. When applying torque, the driving surfaces engage sides of the fastener, thus rotating the fastener in the desired direction. When the wrench is rotated in the opposite direction, the driving surfaces do not engage the fastener, but rather "slip" over the corners of the fastener, thus providing a "ratcheting" action. As such, it is possible for the user to achieve a ratcheting result without the cost and complexity of a conventional ratchet and socket assembly. Such a speed wrench allows the user to apply consistent torque to the hexagonal fastener without requiring the user to remove the wrench head from the fastener when the extremes of the rotational angle are reached. However, a limitation of this type of speed wrench is that it is not usable where lateral access to the fastener is minimal or non-existent.

SUMMARY

The present application utilizes the unique wrench head design of the Mikic et al. patent and incorporates a lug aperture on the wrench head's distal end to readily receive a drive lug of an extension tool, such as a breaker bar or extension handle. As such, the present invention incorporates the benefits of the speed wrench's ratcheting capability to maintain positive contact with the fastener or nut at all times, with the ability for use with a fastener in a location with little or no lateral access.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages, should be readily understood and appreciated.

DETAILED DESCRIPTION

The present application utilizes the unique wrench head design of the aforementioned Mikic et al. patent and features a lug aperture on the wrench head to readily receive a drive lug of an extension handle.

Figure 1:
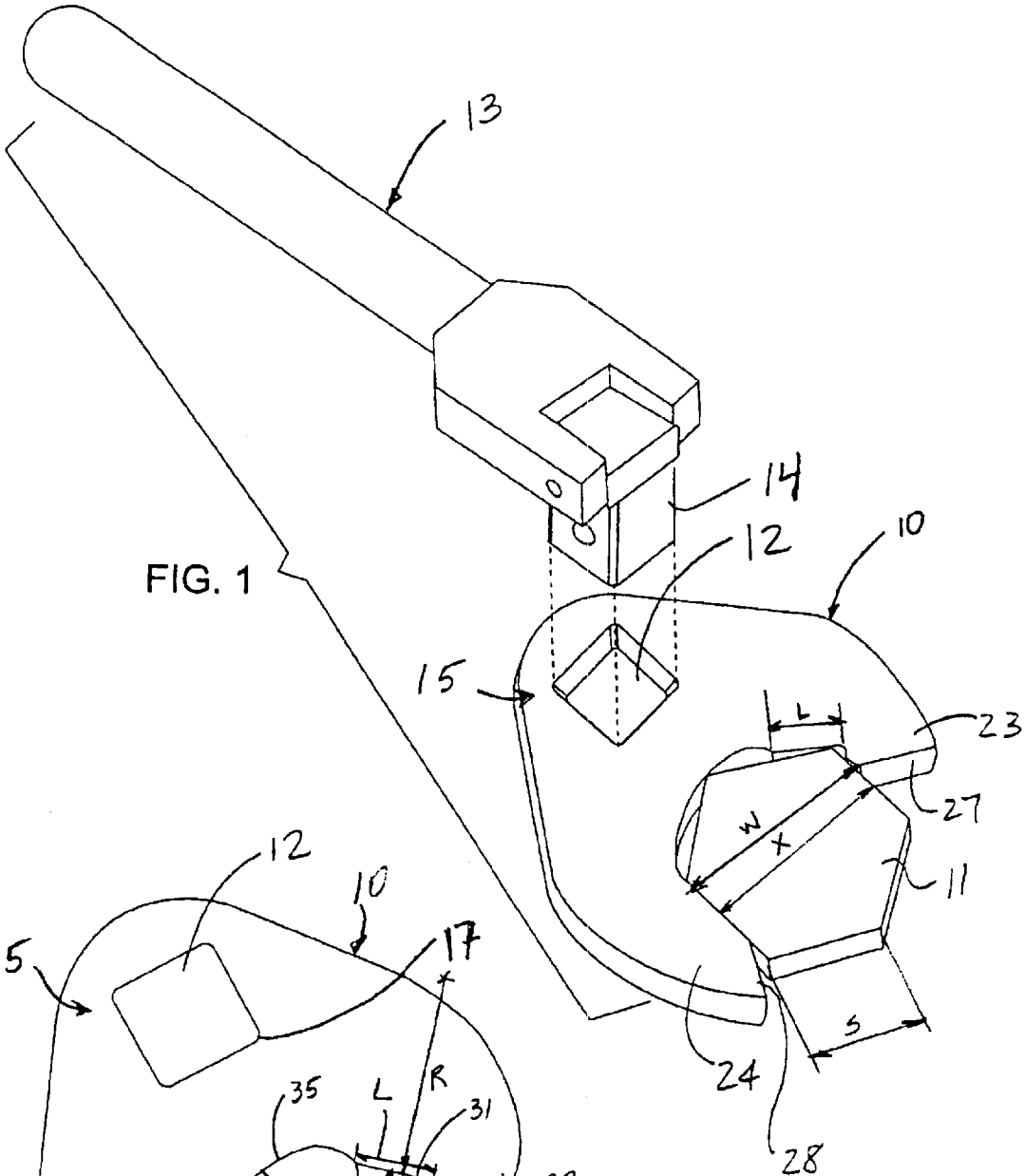
FIG. 1 is a perspective view of an embodiment of the speed wrench head depicting the mateability of an extension handle having a drive lug.
Figure 2:
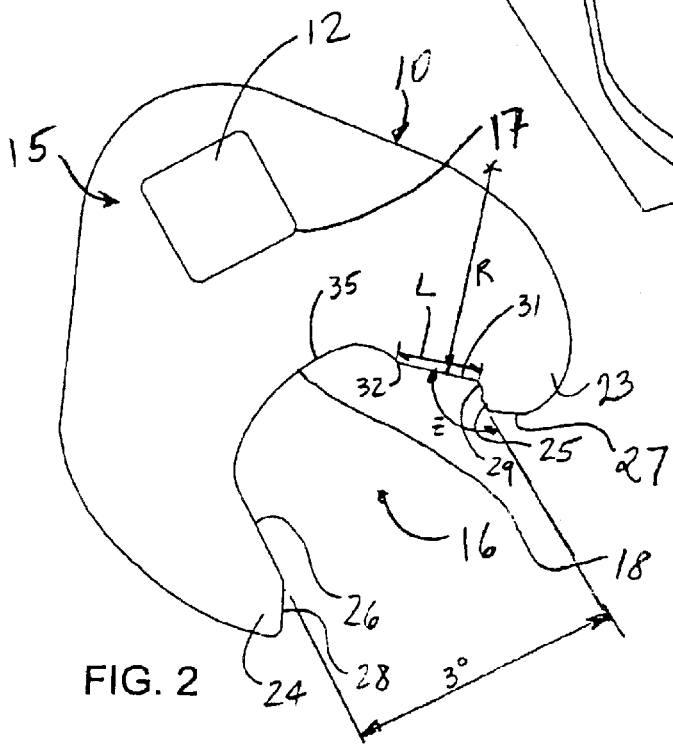
FIG. 2 is a plan view of the speed wrench head of FIG. 1.

Referring to FIGS. 1 and 2, an associated hexagonal fastener 11 has a plurality of substantially flat sides of approximately the same dimension defining an across side dimension X and intersecting at a plurality of corners.

The ratcheting-type wrench head 10 has a short jaw 23 and a long jaw 24, respectively having substantially flat planar driving surfaces 25 and 26 thereon and respectively terminating at the outer or distal ends thereof in truncated angled ends 27 and 28. The driving surface 25 is substantially shorter than the driving surface 26 and, at the inner end thereof, intersects a short arcuate recess 29. The driving surfaces 25 and 26 are spaced apart a distance W slightly greater than the nominal across side dimension X of the fastener 11 for which the wrench head 10 is intended to be used. The driving surfaces 25 and 26 are generally parallel, but they may slightly converge outwardly at a small angle of approximately 3 degrees to improve the flat engaging contact with the opposite sides of the associated fastener 11 despite tolerance size variations in the fastener 11. The length of the short driving surface 25 is long enough to ensure adequate gripping of the fastener 11 during forward rotation and short enough to ensure ratcheting slippage during reverse rotation, and is typically approximately one-tenth the across sides dimension X of the fastener 11.

The wrench head 10 has a throat 18 which interconnects the jaws 23 and 24. The throat 18 includes a generally flat support surface portion 31 which extends from the arcuate recess 29 downwardly away from the driving surface 25. More specifically, the support surface portion 31 is inclined with respect to the driving surface 25 at an angle Z in the range of from about 120 degrees to about 140 degrees and, preferably, approximately 123 degrees. While the support surface portion 31 may be a flat planar surface, it may also be very slightly convex for ease of manufacturing, having a large radius R which is more than twice the distance W between the driving surfaces 25 and 26. The support surface portion 31 terminates at an inner end 32 and has a length L which is substantially less than the nominal side dimension S of the associated fastener 11. In particular, the length L may be in the range of from about ⅓ to about ⅔ the fastener side dimension S and is preferably approximately ½ S, i.e., substantially 0.29 W.

The throat 18 also includes an arcuate portion 35 which extends from the inner end 32 of the support surface portion 31 to the inner end of the driving surface 26.

The present application combines the Mikic et al. wrench head 10 described above with a lug aperture 12 for mateably receiving a drive lug 14 commonly found on conventional extensible handles 13. While a conventional extension bar with an angling drive lug is illustrated in the figures, it will be appreciated that any type of device with a drive lug can be utilized, such as breaker bars, jointed angular extensions, universal joint extensions, "wobble drive" extension bars, extension adapters and the like.

The wrench head 10 mateably receives a drive lug 14 integrated with an extension handle 13. The wrench head 10 incorporates a lug aperture 12 within the wrench head body 15 and disposed adjacent to the throat 18. The lug aperture 12 may have a quadrilateral configuration and arcuate corners 17 for providing enhanced frictional engagement and mateability with a drive lug 14. The lug aperture 12 may extend through the wrench head body 15.

Figure 3:
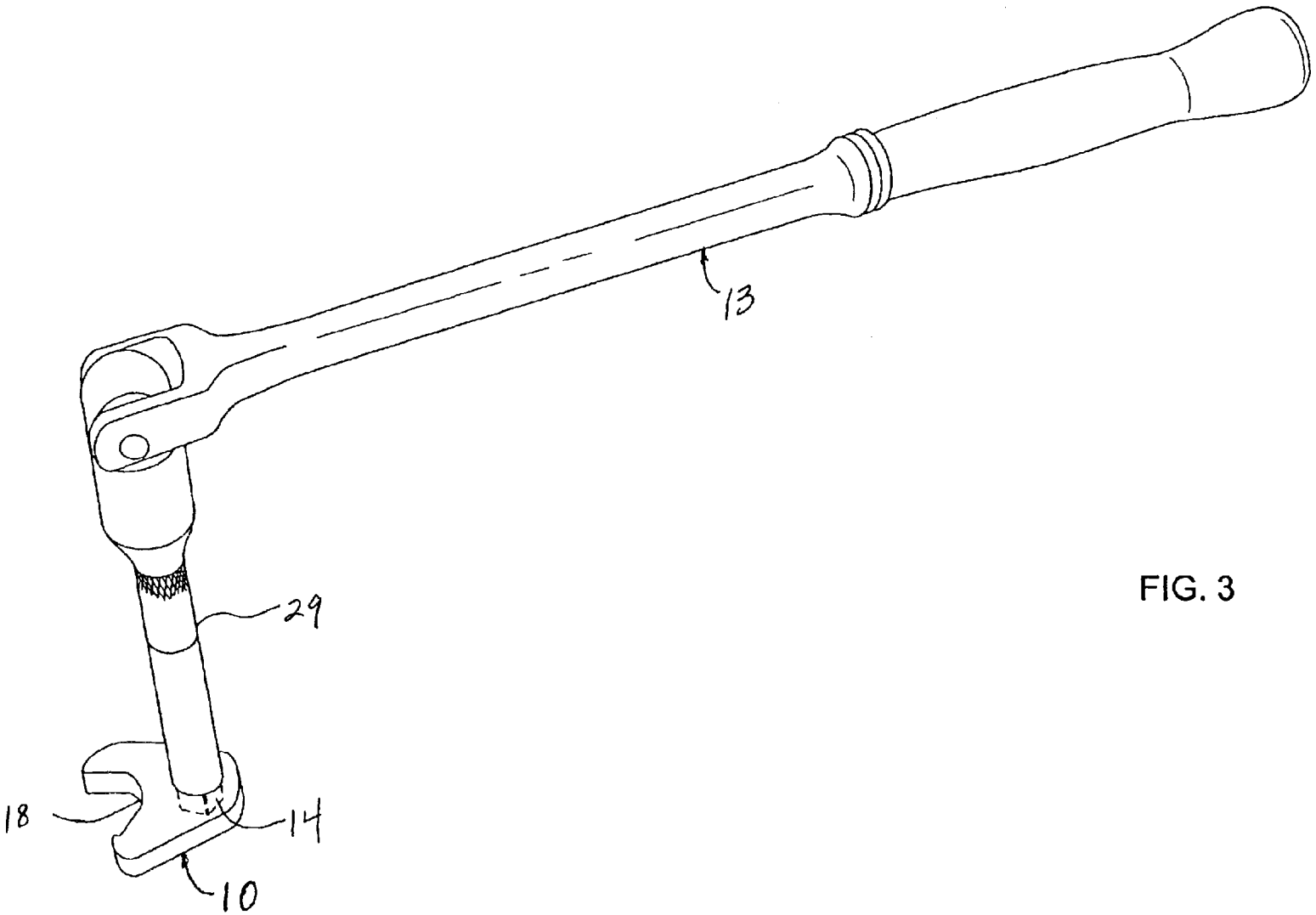
FIG. 3 is a perspective view of an embodiment of the speed wrench head depicting attachment to an extension bar having a drive lug and an extension handle.

Referring also to FIG. 3, which is intended to be an illustration of an example of the wrench head's 10 usability, the wrench head 10 is shown in a mated condition with an extension bar 29, which in turn is mated to an extension handle 13. As will be appreciated, the throat 18 of the wrench head 10 can be oriented in any direction to facilitate remote operability of the wrench head 10.

A method of rotating a fastener with the Mikic et al. ratcheting-type wrench head attached to a handle having a drive lug is also facilitated. The method comprises providing a lug aperture on the wrench head body disposed generally adjacent to the throat for mateably receiving the drive lug, inserting the drive lug into the lug aperture, engaging the wrench head with a fastener, applying a force to the handle in a first direction causing the wrench head and fastener to rotate in unison, and applying a force to the handle in a second direction causing the wrench head to rotate relative to the fastener.

A method of increasing torque imparted to a fastener with the Mikic et al. ratcheting-type wrench head is facilitated by providing an extensible handle with a drive lug thereby increasing the lever length, providing a lug aperture within the wrench head for mateability receiving the drive lug, inserting the drive lug into the lug aperture, engaging the wrench head with the fastener, applying a force to the handle in a first direction causing the wrench head to impart torque to the fastener, and applying a force to the handle in a second direction causing the wrench head to rotate relative to the fastener.

A method of applying the Mikic et al. ratcheting-type wrench head to a fastener disposed in a location having little or no lateral accessibility is facilitated by providing an angle attachment with a drive lug, such as a universal joint extension or a "wobble drive" extension, providing a lug aperture on the wrench head disposed adjacent to the throat of the wrench head for mateably receiving the drive lug, and inserting the drive lug into the lug aperture.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

We claim:

1. A method of rotating a fastener with a ratcheting-type wrench head attached to a handle having a drive lug, the fastener having a plurality of substantially flat sides of approximately the same dimension defining an across side dimension and intersecting at a plurality of corners, the wrench head including two jaws and a throat interconnecting the jaws, the jaws respectively including short and long driving surfaces each shorter than the side dimension of the fastener and respectively defining first and second driving planes spaced apart a predetermined distance slightly greater than the across side dimension and respectively disposed for driving engagement with opposed sides of the fastener, the throat including a generally flat first surface portion adjacent to the short driving surface and inclined with respect thereto at a predetermined angle of at least 120°, the first surface portion extending from a first and between the driving planes to a second end spaced from the short driving surface and disposed on the opposite side of the first driving plane from the long driving surface, the throat including means for defining a recessed second surface portion extending from the first surface portion to the long driving surface and shaped and dimensioned so as to remain spaced in use from an associated fastener which is engaged with the driving surfaces and the first surface portion, the method comprising:

providing a lug aperture on the wrench head disposed adjacent to the throat for mateably receiving the drive lug;

inserting the drive lug into the lug aperture;

engaging the wrench head with the fastener;

applying a force to the handle to cause the wrench head to rotate in a first direction wherein the long and short driving surfaces are adapted to grip opposing sides of the fastener thereby causing the wrench head and fastener to rotate in unison; and applying a force to the handle to cause the wrench head to rotate in a second direction wherein the long and short driving surfaces are adapted to ratchet over the fastener thereby causing the wrench head to rotate relative to the fastener.

2. The method as claimed in claim 1 wherein the lug aperture has a quadrilateral configuration.

3. The method as claimed in claim 2 wherein the lug aperture has arcuate corners.

4. A method of increasing torque imparted to a fastener with a ratcheting-type wrench head, the fastener having a plurality of substantially flat sides of approximately the same dimension defining an across side dimension and intersecting at a plurality of corners, the wrench head including two jaws and a throat interconnecting the jaws, the jaws respectively including short and long driving surfaces each shorter than the side dimension of the fastener and respectively defining first and second driving planes spaced apart a predetermined distance slightly greater than the across side dimension and respectively disposed for driving engagement with opposed sides of the fastener, the throat including a generally flat first surface portion adjacent to the short driving surface and inclined with respect thereto at a predetermined angle of at least 120°, the first surface portion extending from a first end between the driving planes to a second end spaced from the short driving surface and disposed on the opposite side of the first driving plane from the long driving surface, the throat including means for defining a recessed second surface portion extending from the first surface portion to the long driving surface and shaped and dimensioned so as to remain spaced in use from an associated fastener which is engaged with the driving surfaces and the first surface portion, the method comprising:

providing an extensible handle having a drive lug;

providing a lug aperture on the wrench head disposed adjacent to the throat for mateably receiving the drive lug;

inserting the drive lug into the lug aperture thereby increasing the lever length;

engaging the wrench head with the fastener;

applying a force to the handle to cause the wrench head to rotate in a first direction wherein the long and short driving surfaces are adapted to grip opposing sides of the fastener thereby causing the wrench head to impart torque to the fastener; and applying a force to the handle to cause the wrench head to rotate in a second direction wherein the long and short driving surfaces are adapted to ratchet opposing sides of the fastener thereby causing the wrench head rotate relative to the fastener.

5. The method as claimed in claim 4 wherein the lug aperture has a quadrilateral configuration.

6. The method as claimed in claim 5 wherein the lug aperture has arcuate corners.

7. A method of applying a ratcheting-type wrench head to a fastener disposed in a location having little or no lateral accessibility, the fastener having a plurality of substantially flat sides of approximately the same dimension defining an across side dimension and intersecting at a plurality of corners, the wrench head including two jaws and a throat interconnecting the jaws, the jaws respectively including short and long driving surfaces each shorter than the side dimension of the fastener and respectively defining first and second driving planes spaced apart a predetermined distance slightly greater than the across side dimension and respectively disposed for driving engagement with opposed sides of the fastener, the throat including a generally flat first surface portion adjacent to the short driving surface and inclined with respect thereto at a predetermined angle of at least 120°, the first surface portion extending from a first end between the driving planes to a second end spaced from the short driving surface and disposed on the opposite side of the first driving plane from the long driving surface, the throat including means for defining a recessed second surface portion extending from the first surface portion to the long driving surface and shaped and dimensioned so as to remain spaced in use from an associated fastener which is engaged with the driving surfaces and the first surface portion, the method comprising:

providing an angle attachment with a drive lug;

providing a lug aperture on the wrench head disposed adjacent to the throat for mateably receiving the drive lug;

inserting the drive lug into the lug aperture; and engaging the wrench head with the fastener.

8. The method as claimed in claim 7 wherein the lug aperture has a quadrilateral configuration.

9. The method as claimed in claim 8 wherein the lug aperture has arcuate corners.

10. The method as claimed in claim 7 wherein the angle attachment is a universal joint attachment.

11. An extensible ratcheting-type wrench head for rotating a fastener having a plurality of substantially flat sides of approximately the same dimension defining an across side dimension and intersecting at a plurality of corners, the apparatus comprising:

a body having at least two jaws and a throat interconnecting the jaws, the jaws respectively including short and long driving surfaces each shorter than the side dimension of the fastener and respectively defining first and second driving planes spaced apart a predetermined distance slightly greater than the across side dimension and respectively disposed for driving engagement with opposed sides of the fastener, the throat including a generally flat first surface portion adjacent to the short driving surface and inclined with respect thereto at a predetermined angle of at least 120°, the first surface portion extending from a first end between the driving planes to a second end spaced from the short driving surface and disposed on the opposite side of the first driving plane from the long driving surface, the throat including means for defining a recessed second surface portion extending from the first surface portion to the long driving surface an shaped and dimensioned so as to remain spaced in use from an associated fastener which is engaged with the driving surfaces and the first surface portion; and a lug aperture in the body disposed adjacent to the throat for mateably receiving a drive lug of a handle extension.

12. The apparatus as claimed in claim 11 wherein the lug aperture has a quadrilateral configuration.

13. The apparatus as claimed in claim 12 wherein the lug aperture has arcuate corners.

14. The apparatus as claimed in claim 11 wherein the lug aperture extends through the body.

* * * * *